US006448881B1

(12) United States Patent
Taylor

(10) Patent No.: US 6,448,881 B1
(45) Date of Patent: Sep. 10, 2002

(54) MANUALLY OPERATED ACTUATING DEVICE AND METHOD

(75) Inventor: David G. Taylor, Thomasville, GA (US)

(73) Assignee: Taylor-Maddox Technical, Inc., Thomasville, GA (US)

( * ) Notice: Subject to any disclaimer, the term of this patent is extended or adjusted under 35 U.S.C. 154(b) by 118 days.

(21) Appl. No.: 09/652,474

(22) Filed: Aug. 31, 2000

(51) Int. Cl.[7] ..... H01H 71/14; H01H 85/042; H01H 73/02; H01H 85/22

(52) U.S. Cl. ..... 337/171; 337/171; 337/169; 361/115; 361/835

(58) Field of Search ..... 337/169–179; 361/102, 104, 115, 626, 642, 646, 837, 835

(56) References Cited

U.S. PATENT DOCUMENTS 2,076,681 A * 4/1937 Steinmayer ..... 337/176
2,119,388 A * 5/1938 Hermann ..... 337/168
2,172,143 A * 9/1939 Lemmon ..... 200/116
2,176,227 A * 10/1939 Schultz et al. ..... 337/172
2,179,749 A * 11/1939 McCluskey et al. ..... 337/171
2,235,666 A * 3/1941 Birkenmaier ..... 337/176
2,331,839 A * 10/1943 Link ..... 337/171
2,362,314 A * 11/1944 Schultz et al. ..... 337/156
2,655,576 A * 10/1953 Milne et al. ..... 337/139
2,734,964 A * 2/1956 Edwards et al. ..... 200/244
2,816,979 A * 12/1957 Lindell ..... 337/139
3,962,770 A * 6/1976 Dooley et al. ..... 29/203 H
4,321,575 A * 3/1982 Koszewa et al. ..... 337/168
4,433,220 A * 2/1984 Buhler et al. ..... 200/144 AP
4,774,488 A * 9/1988 Field ..... 337/171
5,151,564 A * 9/1992 Rowe ..... 200/17 R
5,191,311 A * 3/1993 Webb et al. ..... 337/168
5,266,759 A * 11/1993 Dohnal et al. ..... 200/144 B
D350,447 S * 9/1994 Zinnbauer ..... D6/500
5,447,016 A * 9/1995 Ueda et al. ..... 53/510
5,477,016 A * 12/1995 Baginski et al. ..... 200/43.11
5,532,668 A * 7/1996 Fennell ..... 337/168
5,534,673 A * 7/1996 Lehmann et al. ..... 218/68
5,534,858 A * 7/1996 Tinkham ..... 340/870.7
5,670,927 A * 9/1997 Fennell ..... 337/168
5,742,220 A * 4/1998 Scherer ..... 337/171
5,861,595 A * 1/1999 Wood et al. ..... 218/12
5,998,748 A * 12/1999 Taylor ..... 200/331
6,093,901 A * 7/2000 Taylor ..... 200/331

FOREIGN PATENT DOCUMENTS

WO WO 01/20633 A1 * 3/2001 ..... H01H/71/10

* cited by examiner

*Primary Examiner*—Anatoly Vortman
(74) *Attorney, Agent, or Firm*—Baker, Donelson, Bearman & Caldwell

(57) ABSTRACT

An actuating device (22) operated by a hookstick (12) is attached to a manually operated fused cutout switch (10) or a oil circuit recloser switch (22). The device (22) is readily clamped to a ring (14) of the switch with a locking member (30) and a cantilever (24), each defining a boss or raised portion (34) and (60, 64, selectively for the cantilever), which bosses are disposed within the ring (14) to bear against an inner surface of the ring. A fastener (40) secures the locking member (30) and the cantilever (24) together. The hookstick (12), being engaged in the receptacle (48, 50), moves the actuating device (22) to alternatively open or close the switch. An alternate embodiment of the cantilever and a method of actuating a manually operated switch are disclosed.

17 Claims, 4 Drawing Sheets

MANUALLY OPERATED ACTUATING DEVICE AND METHOD

This invention relates to manually operated handles for recloser switches and lock outs on pole mounted circuit reclosers used by electric utilities. More particularly, this invention relates to a remotely operated actuating device for affixing to a shaft used to open and close a recloser switch using a hookstick.

BACKGROUND OF THE INVENTION

Commercial and residential electrical power is distributed through electric cables which run along a series of power poles. Many of the poles are strategically mounted with automatic circuit reclosers, which are recognized by electric utilities as essential for achieving an important goal of providing continuity of electric service simply and economically. Some 80 to 95 percent of all system faults on overhead power distribution systems are temporary in nature and last from only a few cycles to a few seconds. These temporary faults are generally caused by wind, lightning, animals, tree branches, and switching surges.

Reclosers sense and interrupt fault currents and automatically restore service after momentary outages by restoring current after the temporary fault condition is gone. If a fault is permanent, the recloser locks open after a preset number of operations and isolates the faulted section of the system from the main system.

Reclosers are mounted near the tops of utility poles and are provided with manually operated reclosing levers, also known as manual operating handles. The reclosing levers are used for manually opening and closing the recloser or setting the recloser to lockout after one operation. These manually operated levers are currently operated by a hand-held hookstick that is 30 to 40 feet in length. The hookstick is operated by utility worker either on a pole, in a bucket truck, or on the ground. The utility worker inserts the hookstick into a ring that extends from the end of the lever and is used to actuate the lever by pressing against the ring with the hookstick.

The prior art hookstick-operated levers are difficult and cumbersome to operate. Inserting the hookstick into the ring requires skill and patience. The difficulty of inserting the hookstick into the ring is further complicated by the conditions in which system faults generally occur. High winds and lightning are leading causes of system faults. Therefore, a need to operate a recloser lever often arises during poor weather and at nighttime. Placing the hookstick into a small ring at the top of a utility pole is even more arduous a task in wet, windy, and dark conditions which may cause numerous failed attempts and become time consuming. Time is of the essence in restoration of electrical power. Moreover, safety of utility personnel is a significant concern. Failed attempts to insert a hookstick into a ring increase the personnel's exposure to weather conditions or electrical hazards. The prior art failed to address these problems associated with the hookstick operated recloser levers.

My earlier US Pat. No. 5,998,748 discloses an improved actuating device which solves the deficiencies found in prior art recloser levers operated by a hookstick and a ring-actuated lever. In particular, the actuating device disclosed therein provides an effective means to make the operation of recloser levers with a hookstick easier and faster. While actuating device of that type accomplishes this goal by eliminating the need to exercise significant skill and patience in placing a hookstick into a ring actuator, there are certain improvements which make the actuating device more readily installed on existing cutout and arrester combinations as well as a wide variety of oil circuit reclosers. These improvements include an actuator device readily adapted to fitting common, different sized rings of cutout switches and a clamping member engagable with conventional tools for mounting the actuator device to the rings or directly to a recloser lever. It is to such that the present invention is directed.

SUMMARY OF THE INVENTION

The present invention as disclosed herein is an improved actuator device for providing operational control of a recloser lever by a hookstick, while being more readily installed on different sized rings of cutout switches. The actuator device consists of an elongate cantilever member that is adapted to attach to the existing ring of the recloser lever, or to replace the existing recloser lever. Once the actuator device of the present invention is installed, the recloser lever may be actuated without finding and placing the hookstick into the ring. Instead, the improved actuator device will allow a user to engage the hookstick by receiving the hookstick in a receptacle of the cantilever and then moving the hookstick in the desired direction to open or close the recloser or adjust the lockout setting. Thus, the recloser lever may be actuated in a single attempt with less precision than needed for inserting the hookstick into a prior art ring. In a preferred embodiment, the receptacle defines a hook-shaped extension in a distal end position of the cantilever.

The present invention provides an actuating device for attachment to an existing ring of a manually operated switch, in which a clamp member defines a raised portion for being disposed within the ring to bear against an inner surface of the ring. A cantilever defines a raised portion for being disposed within the ring to bear against the inner surface of the ring opposing the raised portion of the clamp member. The cantilever includes at least one receptacle at a distal end portion for receiving a hookstick. A fastener secures the clamp member and the cantilever together. The hookstick, being engaged in the receptacle, moves the actuating device to alternatively open or close the switch.

In another aspect, the present invention provides a method of actuating a manually operated recloser and lockout switch mounted on poles of an overhead electrical power distribution system, comprising the steps of (a) securing an existing ring of a manually operated switch between a clamp and a cantilever, each having raised portions that are disposed within the ring for bearing on opposing surfaces thereof; (b) engaging a receptacle on the cantilever arm with a distal end portion of an elongated member; and (c) moving the cantilever arm f from a first position to a second position in response to moving the elongated member, whereby the cantilever arm moves the switch between an open and closed position.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
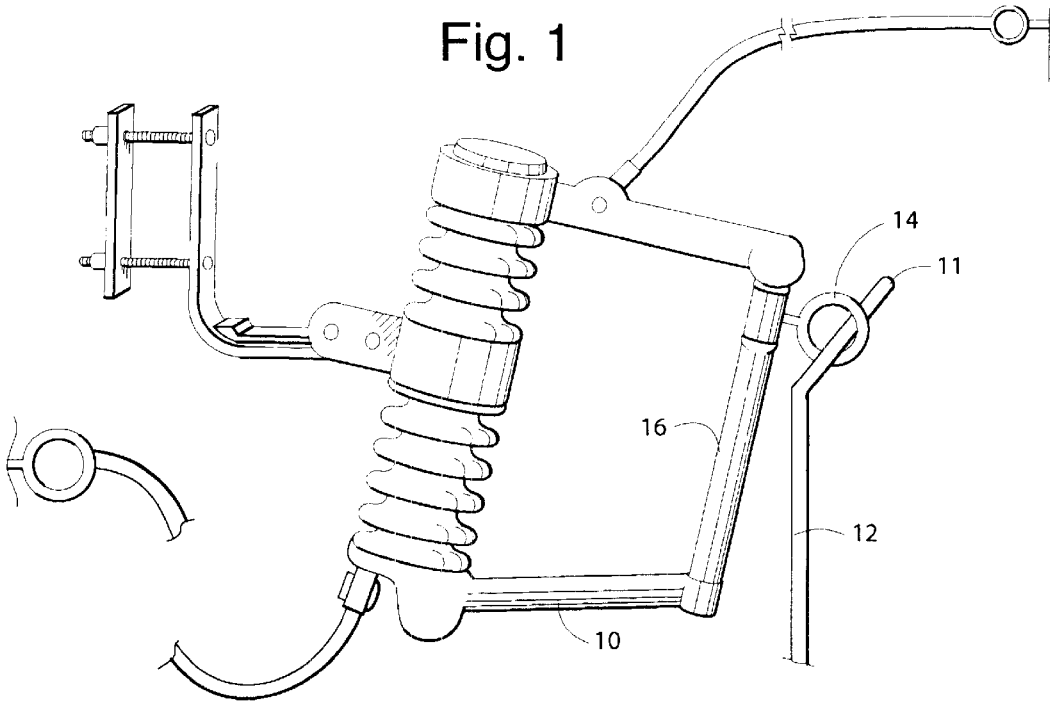
FIG. 1 is a side view of the prior art cutout and arrester combination having a handle and ring manual operating switch.
Figure 8:
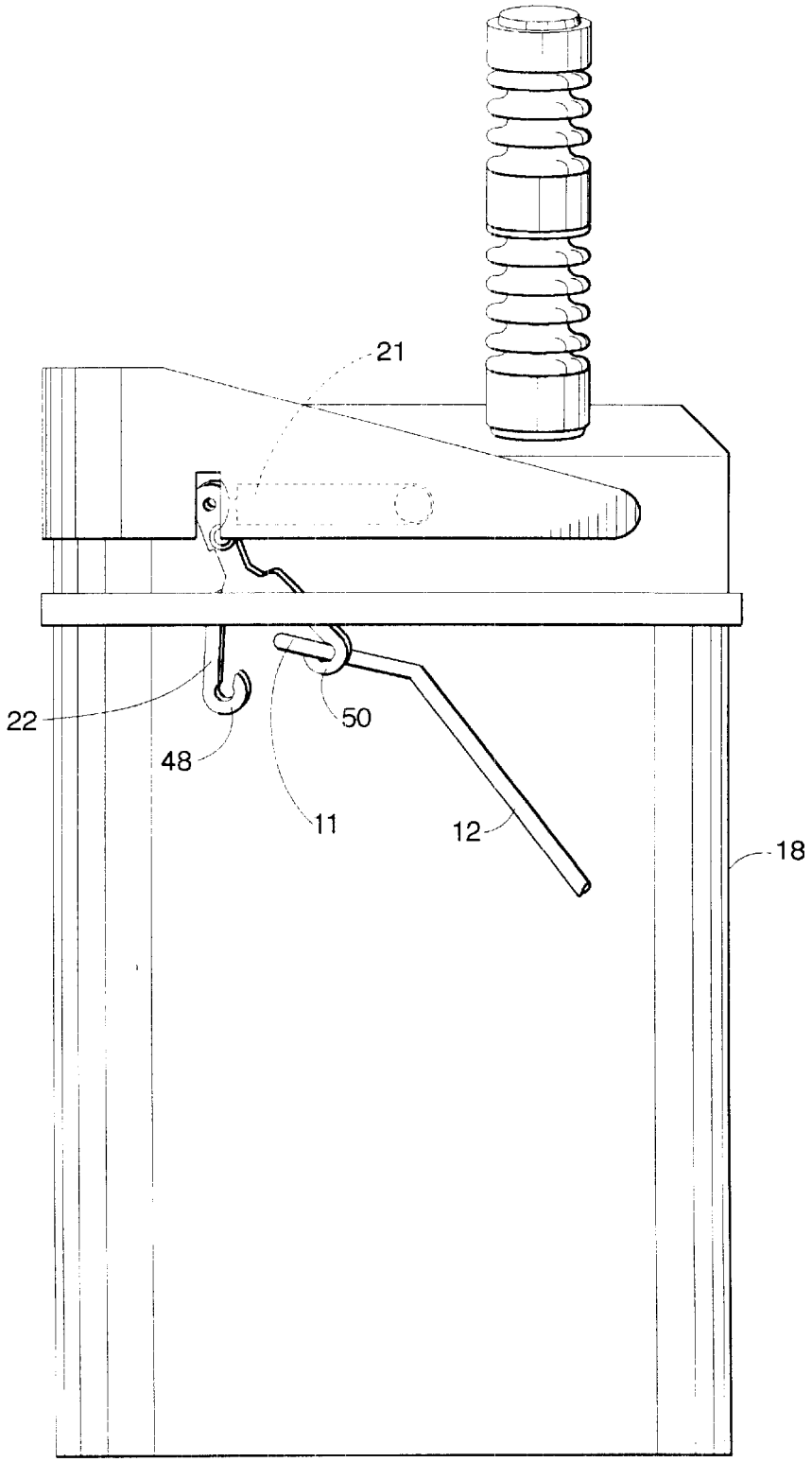
FIG. 8 is side view of the present invention shown attached to a single phase oil circuit recloser.

Referring to the drawings, FIG. 1 illustrates a cutout and arrester combination, also known as a lockout switch or fused cutout switch 10. As shown in FIG. 1, the fused cutout switch 10 is generally operated by manually placing a tip end or limb 11 of a conventional hookstick 12 in a ring 14 and moving the ring to operate a handle 16 that is used to open or close the cutout switch 10. An equivalent method is used in the prior art in conjunction with oil circuit reclosers 18 for manually operating a recloser switch 20. FIG. 8 depicts the oil circuit recloser 18, but with an actuating device 22 of the present invention attached thereto.

Figure 2:
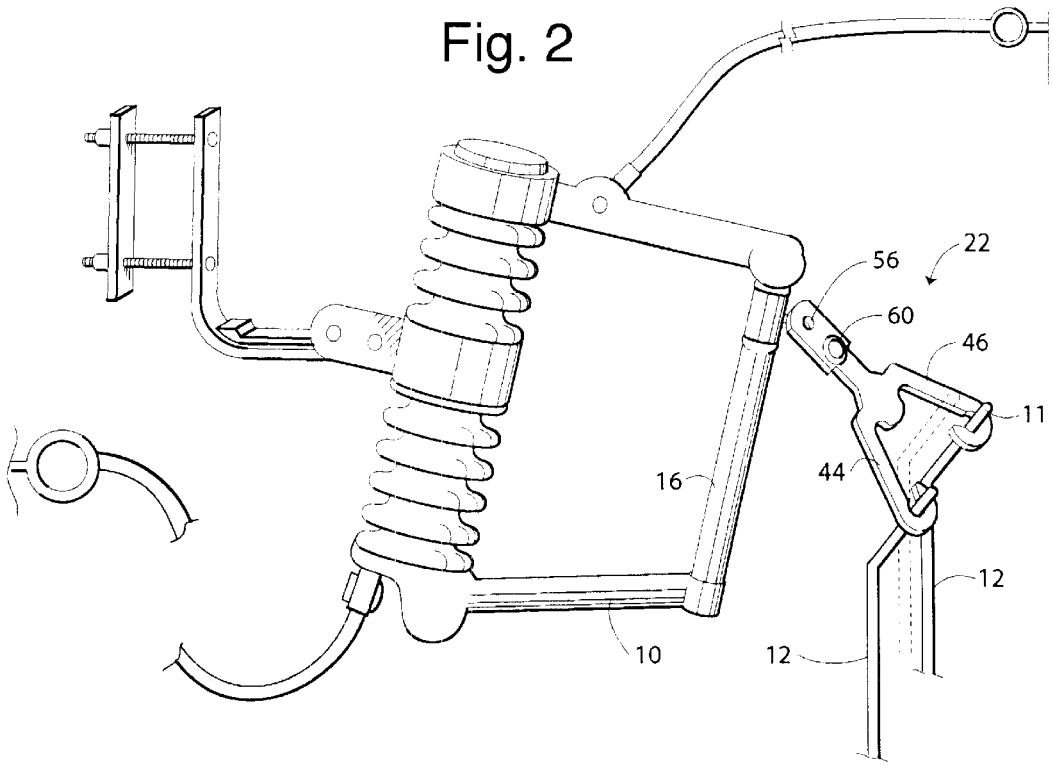
FIG. 2 is a side view of the present invention shown attached to the ring provided on a recloser cutout and arrester combination.

FIG. 2 illustrates a first variation of the actuating device 22 of the present invention as used on the cutout switch 10, illustrated as attached to the existing ring 14. The same hookstick 12 as used in the prior art is used to open and close the cutout switch 10 by engaging the actuating device 22 in alternate positions on the actuating device as shown in the figure. The ring 14 is caused by the actuating device 22 to move the handle 16 in the same manner as before to actuate the switch 10; however, the switch is more conveniently accessed and operated using the present actuating device 22 which device is also more readily installed for use with the switch, as discussed below.

As shown in FIG. 8, the present actuating device 22 also may be used on the oil circuit recloser switch 18 having the same type of ring for engaging the hookstick 12. The actuating device 22 is used on a switch of the oil circuit recloser 18 in the same manner as described previously.

The actuating device 22 two primary parts that are bolted together on the ring 14 of a cutout switch 10 or recloser switch 22. The first part consists of a clamp 30 and the second part consists of a cantilever 24, which parts are discussed below.

Figure 3:
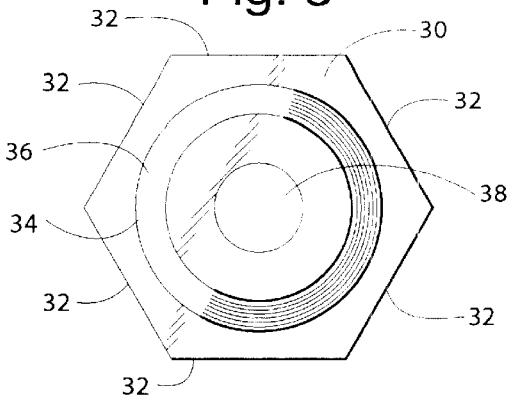
FIG. 3 is a front view of the clamp of the present invention.
Figure 4:
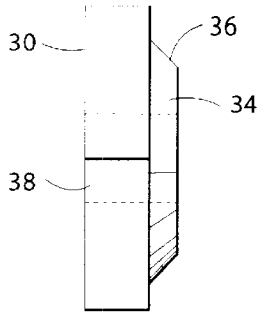
FIG. 4 is a side view of the clamp of the present invention.

With reference to FIGS. 3 and 4, the first part consists of the clamp or locking member 30 having a plurality of planar angled perimeter sides 32 to define a hexagonal shape. The sides 32 permit engagement with conventional wrenches (not illustrated) or other engaging tools while installing the actuating device 22 to the ring 14, as discussed below. The locking member 30 includes a boss or raised portion 34. In the illustrated embodiment, the raised portion 34 has a beveled or taperingly angled side 36 to thereby define a frustroconical projection. A threaded bore 38 is defined through the locking member 30 for engaging a threaded fastener, such as the bolt 40 which is illustrated with a lock washer 42 in FIG. 7. The locking member 30 is molded, preferably by aluminum metal casting. The locking member 30 is approximately 1 ½ inches between directly opposing surfaces 32. The boss or raised portion 34 has bases of approximately 1 inch and ¾ inch with a height or outward extension of approximately ¼ inch.

Figure 5:
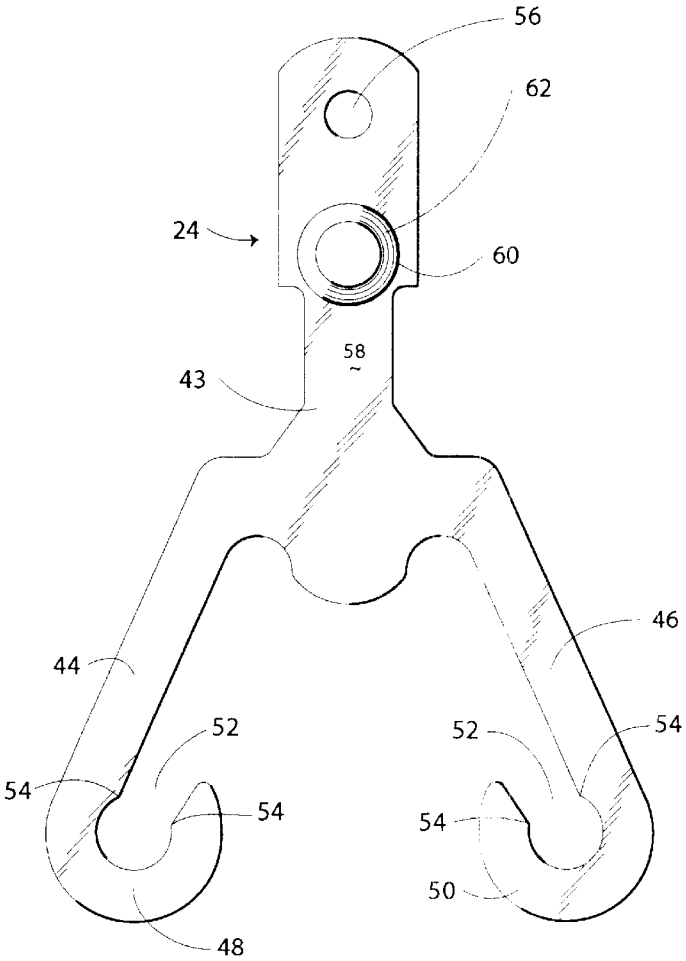
FIG. 5 is a front view of the cantilever of the present invention.
Figure 6:
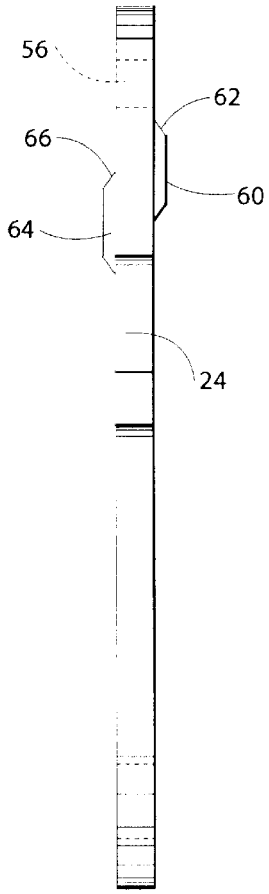
FIG. 6 is a side view of the cantilever of the present invention.

The second part of the actuating device 22 is the cantilever 24 shown in FIGS. 5 and 6. The cantilever 24 in the illustrated embodiment is generally A-shaped with an extended neck 43. The cantilever 24 includes a first lever arm 44 and a second lever arm 46 that oppose each other at an angle. In the embodiment shown, the lever arms 44, 46 are at an oblique angle of about 25 degrees to 35 degrees with respect to each other. Each lever arm 44, 46 terminates in a curved hook-shaped receptacle 48 and 50, respectively, for receiving the limb 11 at the top of the hookstick 12 such as those types commonly used to actuate recloser switches. The hook-shaped receptacles 48, 50 each include a receiving slot 52 sized such that the hookstick limb 11 fits into the receptacle. Opposing sides 51, 53 of the lever arms 44, 46 lead to the respective slots 52. Slight lips 54 may be provided on the receptacles 48, 50 on each side of the receiving slots 52 to hinder the hookstick limb 11 from slipping out of the receptacle while the actuating device 22 is operated. The cantilever 24 is molded, preferably with aluminum casting. The cantilever 24 is approximately 9 inches in overall length and approximately 6 inches wide between the lateral outside surfaces of the first and second lever arms 44, 46 at the widest extent.

As illustrated in front view in FIG. 5 and in side view in FIG. 6, the cantilever 24 defines an aperture 56. This aperture 56 in the cantilever 24 aligns with the aperture 38 on the clamp 30. A planar face 58 defines a boss or raised portion 60 in the neck 43. In the illustrated embodiment, the raised portion 60 is annular with a beveled, taperingly angled side 62 to thereby define a frustroconical projection. The raised portion 60 is spaced-apart from the aperture 56. Further in the illustrated embodiment, an opposing face defines an opposing second boss or raised portion 64 which likewise is annular with a beveled, taperingly angled side 66 to thereby define a frustroconical projection. In the illustrated embodiment, the raised portions 60, 64 have bases of about 1 inch and ⅝ inch, with a height or extension from the surface of about ⅜ inch. The second raised portion 64 is spaced-apart a different distance from the aperture 56, whereby the cantilever 24 is engagable to different size rings 14, as discussed below. In the illustrated embodiment, the first raised portion 60 and the aperture 56 are spaced apart on a 1 ⅛ inch center, while the second raised portion 64 is spaced from the aperture 56 on a 1 ⅜ inch center.

Figure 7:
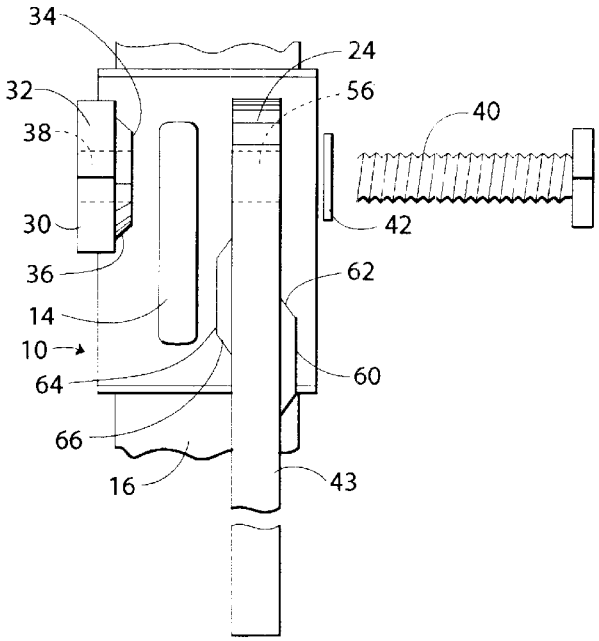
FIG. 7 is an exploded side view of the present invention for attaching to the ring of the switch.

With reference to FIG. 7, the cantilever 24 is attached to the ring 14 with the bolt 40 inserted through the apertures 56, 38 of the cantilever 24 and the clamp 30, thereby sandwiching the ring 14 therebetween . This is accomplished by the ring receiving the raised portion 34 of the clamp 30 and a selected one of the raised portions 60, 64 of the cantilever 24 on opposing sides of the ring 14. The bolt 40 receives the lockwasher 42 and passes through the aperture 56 and threadingly engages the bore 38 of the clamp 30. Tightening the bolt 40 forces the raised portions 34 and 60 (or 64) against the inner wall of the ring 14 and thereby secures the cantilever 24 to the ring. Conventional wrenches or other gripping tools readily engage the planar sides 32 of the locking member 30 for tightening the bolt 40 and the locking member together, and thereby clamping the cantilever 24 to the ring 14 for using the actuating device 22. The differing spacing of the raised portions 60, 64 permit the cantilever 24 to be secured to conventional, different size rings 14. The beveled sides 36, 62, and 66 facilitate the actuating device being received on the different size rings.

The actuating device 22 actuates the cutout switch 10 (or the recloser 18) by sliding the tip 11 of the hookstick 12 along the respective contact surface 51, 53 of the lever arms 44, 46 of the cantilever 24. The limb 11 of the hookstick 12 is guided longitudinally therealong into and through the slot 52 into the respective receptacle 48, 50. The limb 11 is pressed against the inner wall of the receptacle 48, 50 to move the cantilever 24. As the cantilever 24 is moved, the switch to which the cantilever is connected likewise moves, in order to operate the switch to either open or close the switch, depending on moving the hookstick 12 in a first direction or a second opposing direction. As illustrated in FIG. 8, the cantilever 24 may also be attached to a threaded hole at the end of a shaft or other linking member that communicates with the switching mechanism 22 within the recloser cylinder 18 to cause the recloser circuit to open and close.

Figure 9:
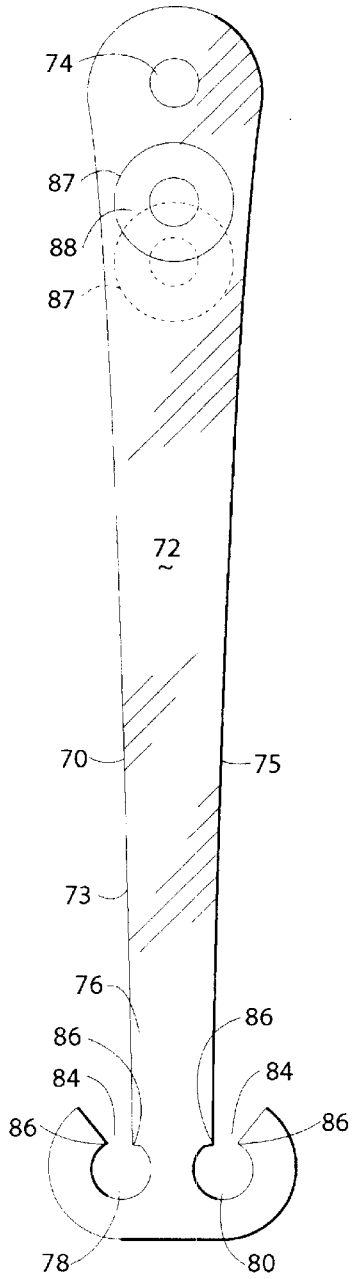
FIG. 9 is a front view of an alternate embodiment of the cantilever for the actuating device of the present invention.

FIGS. 9 illustrates an alternate embodiment 70 of a cantilever actuator device according to the present invention for attaching to the ring 14 of a cutout switch 10 or for attaching to an oil circuit recloser switch 21. As shown in front view, the cantilever 70 comprises an elongate, preferably planar, member 72 with opposing sides 73, 75. The member 72 defines an aperture 74 in a planar surface in a first portion 77. An opposing distal end portion 76 defines a pair of opposing receptacles 78, 80. In the illustrated embodiment, the receptacles 78, 80 define hook-shaped extensions from the member 72. The receptacles 78, 80 open with gaps or slots 84 outwardly laterally of the member 72. The slots 84 are sized for receiving the limb 11 at the top of the hookstick 12. Slight lips 86 may be provided on the receptacles 78, 80 on opposing sides of the receiving slots 84 to hinder the hookstick 12 from slipping out of the receptacle 78, 80 while the actuating device comprising the cantilever 70 is moved to operate the switch to which the cantilever is attached. The opposing sides 73, 75 of the member 72 define contact surfaces for guiding the end 11 of the hookstick 12 to the receiving slots 84 and into the receptacle 78, 80. An alternate embodiment has one of the hook-shaped receptacles 78.

As with the cantilever 24, the first portion 77 includes at least one raised portion 86 with a tapered side 88, which defines a frustroconical extension. Preferably, two raised portions are defined on opposing surfaces, which are spaced differently from the aperture 74 for accommodating different sized rings 14, as discussed above.

The alternate embodiment cantilever 70 connects to the ring 14, as discussed above. The bolt 40 extends through the aperture 74 in the cantilever 70, through the ring 14, and threadingly engages the bore 38 in the clamp 30. Tools grip the sides 32 of the clamp for tightening the clamp and the cantilever together. In use, the tip end 11 of the hookstick 12 moves along the respective contact surface 73, 75 for guiding entry into a selected receptacle 78, 80. Movement of the hookstick 12 in a first direction or an opposing second direction causes the cantilever 70 to move. In response, the switch is moved, in order to operate the switch to either open or close the switch.

The present invention accordingly provides an improved actuating device more readily installed on different sized rings of cutout switches while providing operational control of a switch on an electrical power pole by a conventional hookstick. While various embodiments of actuating devices of the present invention have been shown in the drawings and described, variations in the invention's embodiments and practice will be readily apparent to those persons skilled in the art. Therefore, the invention should not be construed as limited to the specific form shown and described, but instead is as set forth in the following claims.

What is claimed is:

1. An actuating device for attachment to an existing ring of a manually operated switch, comprising:

a clamp member defining a raised portion for being disposed within the ring to bear against an inner surface of the ring;

a cantilever defining a raised portion for being disposed within the ring to bear against the inner surface of the ring opposing the raised portion of the clamp member, and said cantilever including at least one receptacle at a distal end portion for receiving a hookstick; and a fastener for securing the clamp member and the cantilever together, whereby said hookstick moves said actuating device to alternatively open or close said switch.

2. The actuating device of claim 1, wherein the respective raised portions are disposed in opposing relation.

3. The actuating device of claim 1, wherein said cantilever comprises an elongate member that includes a pair of opposing receptacles at the distal end.

4. The actuating device of claim 3, wherein said pair of receptacles open in opposing lateral directions outwardly of the cantilever.

5. The actuating device of claim 4, wherein the receptacles define hook-shaped extensions.

6. The actuating device of claim 1, wherein said receptacle is a hook-shaped extension.

7. The actuating device of claim 1, wherein said cantilever includes a first lever arm having a terminal end and a second lever arm having a terminal end, said first lever arm and second lever arm being angularly disposed with respect to each other.

8. The actuating device of claim 7, wherein said terminal ends each define hook-shaped receptacles for receiving the hookstick.

9. The actuating device of claim 7, wherein said first lever arm is disposed at a 25 degree to 35 degree angle with respect to the second lever arm.

10. The actuating device of claim 1, wherein said actuating device is attached to the operating member of an oil circuit recloser switch.

11. The actuating device of claim 1, wherein said actuating device is attached to a ring of a fused cutout switch.

12. The actuating device of claim 1, wherein the respective raised portions define tapering side walls.

13. The actuating device of claim 1, wherein the respective raised portions define frustroconical projections.

14. The actuating device of claim 1, wherein the clamp member defines a threaded bore for receiving the fastener.

15. A method of actuating a manually operated switch mounted on poles of an overhead electrical power distribution system, comprising the steps of:

(a) securing an existing ring of a manually operated switch between a clamp and a cantilever, each having raised portions that are disposed within the ring for bearing on opposing surfaces thereof;

(b) engaging a receptacle on the cantilever arm with a distal end portion of an elongated member; and (c) moving the cantilever arm from a first position to a second position in response to moving the elongated member, whereby the cantilever arm moves the switch between an open and closed position.

16. The method as recited in claim 15, wherein step (b) comprises moving the distal end of the elongate member into a hook-shaped receptacle at a distal end of the cantilever arm.

17. A method of actuating a manually operated recloser and lock-out switch mounted on poles of an overhead electrical power distribution system, comprising the steps of:

(a) sandwiching a ring extending from a recloser and lock-out switch with a clamp and a cantilever arm, the clamp having an annular raised portion received within the ring and the cantilever arm having an annular raised portion received in opposing relation thereto, the respective raised portions bearing on a surface of the ring;

(b) securing the cantilever arm to the clamp;

(c) moving a distal end of an elongate member into engagement with one of a pair of opposing receptacles on a distal end of the cantilever arm, and (d) moving the cantilever arm from a first position to a second position by bearing on the cantilever arm with the elongate member, whereby the cantilever is caused to move the recloser and lock-out switch between an open and closed position.

* * * * *